US008353386B2

(12) United States Patent
Helms

(10) Patent No.: US 8,353,386 B2
(45) Date of Patent: Jan. 15, 2013

(54) SAFETY HARNESS

(76) Inventor: James K. Helms, St. Augustine, FL (US)

( * ) Notice: Subject to any disclaimer, the term of this patent is extended or adjusted under 35 U.S.C. 154(b) by 0 days.

(21) Appl. No.: 13/294,475

(22) Filed: Nov. 11, 2011

(65) Prior Publication Data

US 2012/0055737 A1 Mar. 8, 2012

Related U.S. Application Data

(62) Division of application No. 12/287,486, filed on Oct. 9, 2008, now Pat. No. 8,056,675, which is a division of application No. 11/440,752, filed on May 25, 2006, now abandoned.

(51) Int. Cl.
*A62B 35/00* (2006.01)

(52) U.S. Cl. ..... 182/3

(58) Field of Classification Search ..... 182/3
See application file for complete search history.

(56) References Cited

U.S. PATENT DOCUMENTS

| | | | | | |
|---|---|---|---|---|---|
| 2,166,890 | A | | 7/1939 | Desmond | |
| 3,424,134 | A | * | 1/1969 | Rosenblum | 182/3 |
| 4,120,377 | A | | 10/1978 | Charles et al. | |
| 4,273,215 | A | | 6/1981 | Leggett | |
| 4,405,034 | A | | 9/1983 | Dunne | |
| 4,579,196 | A | | 4/1986 | Allen et al. | |
| 4,687,074 | A | | 8/1987 | Green | |
| 4,991,689 | A | * | 2/1991 | Cole | 182/3 |
| 5,433,289 | A | * | 7/1995 | O'Rourke | 182/3 |
| 5,615,750 | A | | 4/1997 | Phillips | |
| 5,738,046 | A | | 4/1998 | Williams et al. | |
| 6,012,993 | A | | 1/2000 | Guerriero | |
| 6,035,440 | A | | 3/2000 | Woodyard | |
| 6,035,966 | A | | 3/2000 | Lewis | |
| 6,125,966 | A | * | 10/2000 | Jones | 182/3 |
| 6,367,582 | B1 | | 4/2002 | Derby | |
| 6,374,946 | B1 | | 4/2002 | Petzl et al. | |
| 6,527,082 | B1 | * | 3/2003 | Taylor | 182/3 |
| 6,637,547 | B1 | | 10/2003 | Wydner | |
| D490,938 | S | | 6/2004 | Wydner | |
| 6,892,395 | B2 | | 5/2005 | Schweer | |
| 7,000,730 | B1 | | 2/2006 | Ostrobrod | |
| 7,036,628 | B2 | | 5/2006 | Wilcox et al. | |
| 7,051,836 | B2 | | 5/2006 | Green | |
| 7,490,610 | B2 | | 2/2009 | Franklin | |
| 2003/0196245 | A1 | | 10/2003 | Schweer | |
| 2005/0194211 | A1 | | 9/2005 | O'Shall et al. | |
| 2005/0230184 | A1 | * | 10/2005 | Ansaldo | 182/3 |
| 2005/0263347 | A1 | | 12/2005 | Hill et al. | |
| 2006/0048998 | A1 | * | 3/2006 | Wolner et al. | 182/3 |

OTHER PUBLICATIONS

Yates Professional Tower Rope Access Harness, p. 1.
Heavy Duty Rescue Safety Harness, pp. 1-3.
MSA North America, Gravity™ Rigger/Rescue Harness, pp. 1-3.
Bowsite.com, Harness, pp. 1-7.

* cited by examiner

*Primary Examiner* — Alvin Chin Shue
(74) *Attorney, Agent, or Firm* — Thomas C. Saitta

(57) ABSTRACT

An improved safety harness and method of using same that allows for self-rescue and suspension trauma relief from either a vertical or horizontal anchor, such as a tree or an overhead beam, the safety harness having an adjustable front tie-in assembly whereby the distance between the waist strap and the thigh straps can be adjusted. The wearer is able to change from rear suspension to front suspension after a fall without the necessity of completely detaching from a safety line.

2 Claims, 14 Drawing Sheets

51
34
51a
21
54
55

51
34
51a
21
54
55

51
51a
21
54
55
34

SAFETY HARNESS

This patent application is a divisional application of U.S. patent application Ser. No. 12/287,486, filed Oct. 9, 2008, now U.S. Pat. No. 8,056,675, issued Nov. 15, 2011, which is a divisional application of U.S. patent application Ser. No. 11/440,752, filed May 25, 2006, now abandoned, the benefits and disclosures of which are claimed herein.

BACKGROUND OF THE INVENTION

The invention relates in general to safety harnesses, such as are worn on the torso of the body, and which in combination with safety lines serve to arrest a fall by the wearer from an elevated location, such as a hunting tree stand, a multi-story building under construction or the like. More particularly, the invention falls into the class of safety harnesses that allow for relief of suspension trauma and/or self-rescue.

Safety harnesses consisting of multiple straps, connectors and fastening elements for use by hunters, construction workers or the like are well known. A typical safety harness comprises a waist strap or waist belt that can be opened and closed to allow the harness to be easily put on and removed, fixed or length-adjustable rear shoulder straps and fixed or length-adjustable front shoulder straps connected to said waist strap, and thigh-straps connected to said waist strap by rear leg straps. Other harnesses utilize groin straps rather than thigh straps. Various types of closure members are utilized to adjust the length of the straps and to connect ends of the straps together, such as pass-through buckles or clip buckles. Connection means for connecting the harness to a safety line fixed to an anchor member, such as a tree or beam, are provided, and may comprise metal rings, hooks, carabiners or the like. The connection means are disposed either to the front of the harness, typically on the waist strap, or to the rear of the harness, typically at a junction of the front and rear shoulder straps.

There are various problems with the known harness designs. Known safety harnesses do not provide self-rescue and suspension trauma relief due to their current designs. Current designs have thigh straps whose distance from the waist strap cannot be adjusted, meaning that the harness design does not take into account the fact that the distance from the waist to the thighs can vary greatly between different users, or the designs use groin straps, which while length-adjustable are not the best suited design for avoiding injury when the harness arrests the falling user. The front tie-in members are located in a fixed position on the waist strap. No systems, kits or methodologies are known that utilize the improved structure for the harness described herein and which provide a means and method for both self-rescue and suspension trauma relief.

When a wearer falls, the body is suspended in air. If the wearer is suspended for a significant period of time, an effect known as suspension trauma will occur if the wearer cannot maintain sufficient movement in his legs over time to keep the blood circulating. Suspension trauma, also known as orthostatic intolerance, results in blood pooling in the legs when the human body is unnaturally suspended in the vertical orientation. When suspended from a safety harness, the pooling is the result of gravity as well as restriction by the groin straps or thigh straps, such that the heart cannot circulate enough blood to the brain. This leads to fainting and then death if the condition is not remedied.

It is an object of this invention therefore to provide a new and improved construction and design for a safety harness and fall arrest system, such that suspension trauma is minimized or relieved, and further such that the wearer can perform a self-rescue rather than having to wait for outside help. It is an object to provide such a harness and self-rescue system that can be utilized for either vertical anchor members (e.g., trees) or horizontal anchor members (e.g., overhead beams in a building under construction). It is a further object to provide a methodology for self-rescue using the safety harness and system described herein.

SUMMARY OF THE INVENTION

In general the invention comprises an improved safety harness that provides for suspension trauma relief and provides a means for self-rescue regardless of whether the wearer is suspended from a vertical or a horizontal anchor member and regardless of whether the wearer is suspended from the front or the back. The safety harness comprises in general an adjustable waist strap or waist belt, rear shoulder straps and front shoulder straps connected to the waist strap, thigh straps connected to the waist strap by rear leg straps, and an adjustable front tie-in assembly comprising a tie-in loop slidingly disposed on the waist strap and length adjustable forward leg straps connecting the thigh straps to the tie-in loop. A pair of lineman loops is preferably disposed laterally on the waist strap. The front and rear shoulder straps are preferably fixedly joined to the waist strap. Rear fall arrest means are disposed on the rear of the harness, and preferably comprises a multiple apertured sling member, commonly referred to as slotted webbing or an omni sling, and depending upon the form of anchor member, back tether member formed in the same manner. Such safety line members are removably connectable to the safety harness. Preferably a rear safety assembly is also provided for use with horizontal anchor members, such assembly comprising a rear slotted safety line member and a foot loop sling member. Optionally, an additional sling member may be provided as a component of the rear safety assembly for use as a front tether.

When the anchor member is a vertical anchor, such as a tree, the wearer cinches or chokes the upper portion of the slotted safety line member around the tree trunk and attaches the safety line to the front tie-in member in order to scale the tree. In circumstances where the user would sit or stand with his back to the tree, the back tether member is then connected to the safety line at a point near the choke point. In the event of a fall, the wearer is suspended vertically from the back tether and the safety line. If there is a sufficient tail on the safety line, the wearer attaches this tail to the front tie-in of the harness, if not already so attached, and then fashions a foot sling by cinching an extra sling member around the vertical anchor at a point such that loop is located where the wearer can bend his leg to insert his foot. Rising up to create slack in the safety line the back tether is disconnected, such that he is now suspended from the front tie-in member—a position that allows for easier movement of the legs and relief from suspension trauma. The wearer may now wait for rescue or perform a self-rescue by moving up or down the vertical anchor, which is accomplished by alternately re-positioning the foot loop sling and safety line up or down the vertical anchor.

In the event of rear suspension from a horizontal anchor and the rear safety assembly, the wearer fashions a foot loop in the foot loop sling member that is attached to the safety line at a point above the primary attachment point at a height that provides a knee-bent posture, connects the free tail of the safety line or the front tether member to the front tie-in loop, rises up to create slack, and disconnects the attachment at the rear of the harness.

DETAILED DESCRIPTION OF THE INVENTION

With reference to the drawings, the invention will now be described in detail with regard for the best mode and the preferred embodiment. In general, the invention is an improved safety harness and safety harness system to restrain the wearer in the event of a fall from an elevated position, such as a tree, building under construction, or the like, the safety harness limiting the fall to a relatively short distance, wherein the device provides mechanisms for front or rear attachment to safety lines and allows the wearer to switch between front and rear attachments without being unattached during the transfer. The invention is structured to minimize or eliminate the occurrence of suspension trauma, i.e., blood pooling in the legs as a result of being suspended in a vertical orientation for excessive periods of time in a manner whereby circulation of blood in the legs is restricted. The invention provides a methodology to assume a horizontal posture to await rescue, and more importantly provides a methodology for self-rescue, in that the wearer can extricate himself from the suspended position without outside assistance by safely transferring from a rear attachment to a front attachment even when in the suspended mode.

Figure 1:
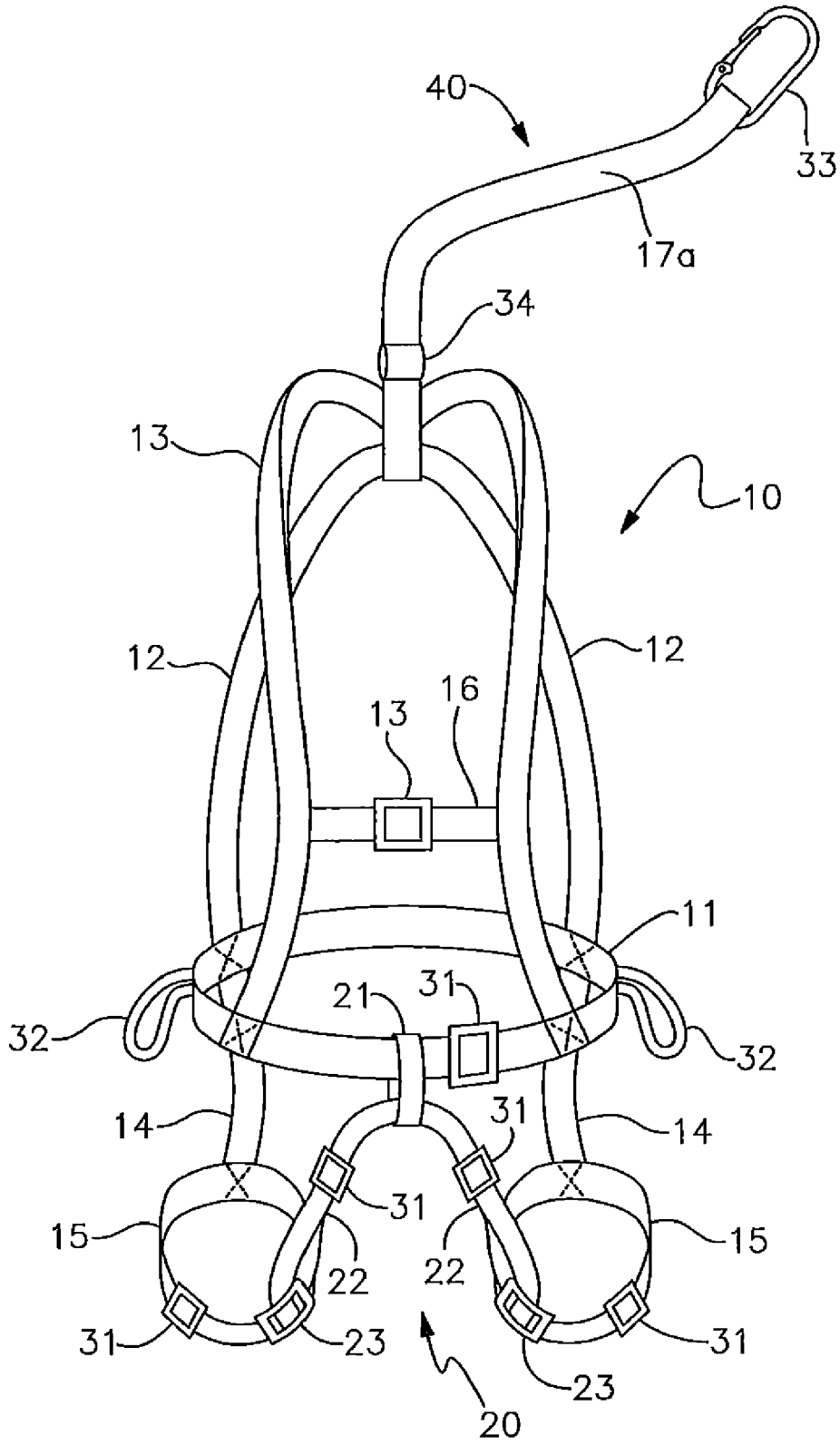
FIG. 1 is a front view of the invention shown in the in-use configuration with all connecting members engaged.
Figure 2:
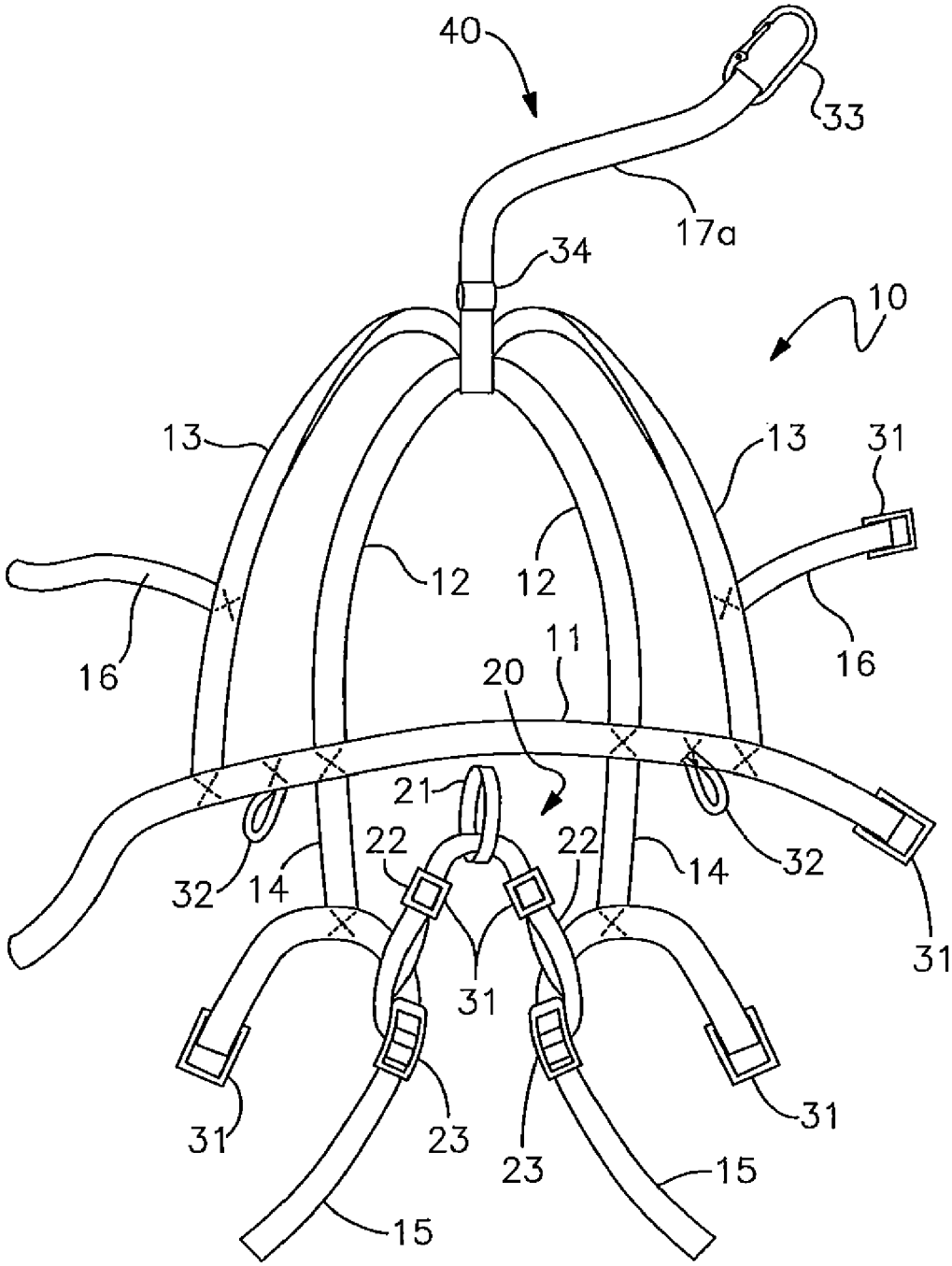
FIG. 2 is a front view of the invention shown with the body encasing elements in a disengaged configuration.

As shown in FIGS. 1 and 2, the invention is a safety harness 10 comprising a waist strap or belt 11, a pair of rear shoulder straps 12, a pair of front shoulder straps 13, a pair of rear leg straps 14, a pair of encircling thigh straps 15, an adjustable front tie-in assembly 20, and preferably a sternum strap 16. Dependent on whether a vertical (e.g., tree) or horizontal (e.g., beam) member is the anchor to which the harness 10 is secured, the harness 10 will further comprise either a back tether strap 17*a* or a D-ring or similar mechanism 17*b*. The term strap is used herein to refer to either a single web member fixedly joined to another member at both ends, such as with rear shoulder straps 12, front shoulder straps 13 and rear leg straps 14, or a one-piece member which is connected to itself to form a looped configuration by a buckle, clasp or similar releasable connecting member 31, such as with the waist strap 11 and thigh straps 15, or a two-piece assembly wherein each piece is fixedly joined to another member at one end and the free ends are connected together using a connecting member 31, such as the sternum strap 16. The straps are composed of materials meeting applicable safety regulations and standards for safety harnesses, and such are well known in the field. Preferably, the connecting members 31 comprise double-pass metal buckles, but buckles of other material, two-part clasp members, or similar releasable connecting members could also be utilized. The harness 10 is adapted for connection to rear fall arrest means 40, which comprises at least a slotted safety line member 41.

Figure 6:
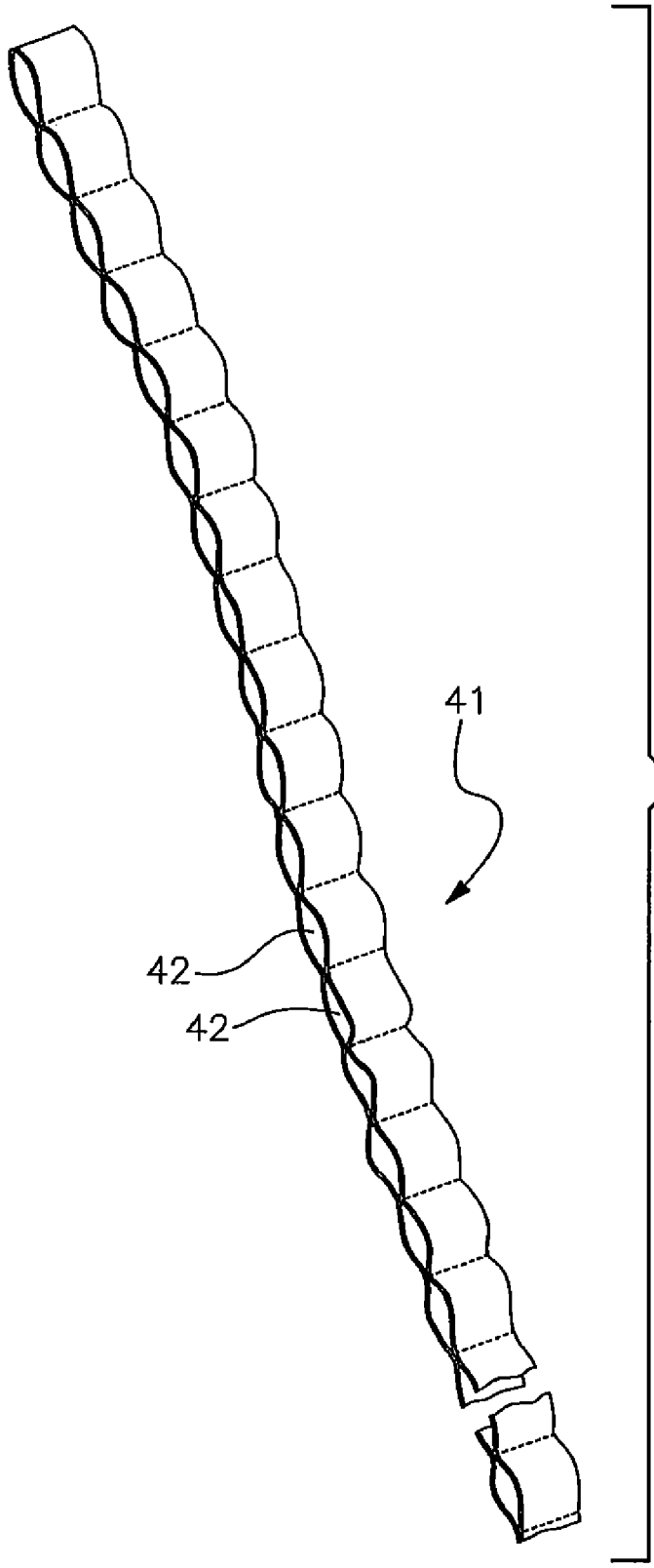
FIG. 6 is a perspective view of a preferred embodiment for a sling member element of the invention assembly.

The safety line member 41 is preferably of the type known as a slotted web or omni sling, as shown in FIG. 6, in that the safety line member comprises a relatively large number of slots or openings 42 to which other strap members may be attached using carabiners, clasps, hooks or the like. With this construction, attachment can be accomplished at any point along the safety line 41. The safety line member 41 is the member that is secured to the anchor member—either directly by cinching or choking the safety line member 41 around the anchor member, or by connecting the safety line member 41 to some other securing means mounted upon the anchor member.

Preferably at least one additional slotted sling member 18, of similar construction to the safety line member 41, is provided, each sling member 18 being an extended piece of webbing that is strong enough to easily support the weight of the user. The slotted sling members 18 may be used as a lineman's loop for encircling a tree, pole or similar object to assist in climbing or installing climbing aids such as screw-in steps, ladders or the like, or are used as safety slings for connection of the safety harness 10 to a tree, beam or other fixed member, or are used as support slings during self-rescue by fashioning a foot loop, and simultaneously as required. Preferably, the sling member 18 has multiple openings 19 spaced along its length, such that carabiners, rings or similar connecting means can be located at multiple positions along the slotted sling member 18.

Figure 3:
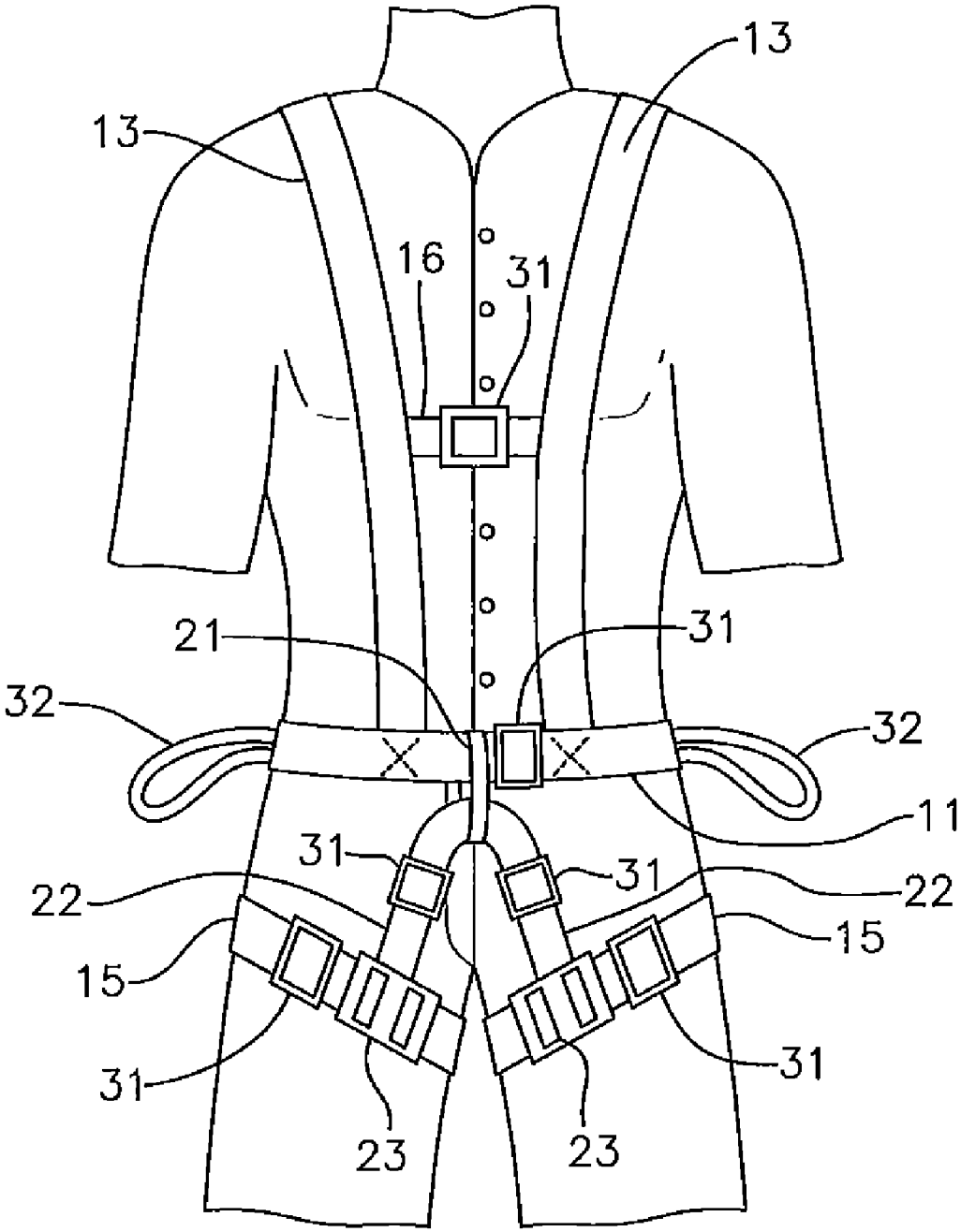
FIG. 3 is a front view of the invention shown in the in-use configuration on a body.
Figure 4:
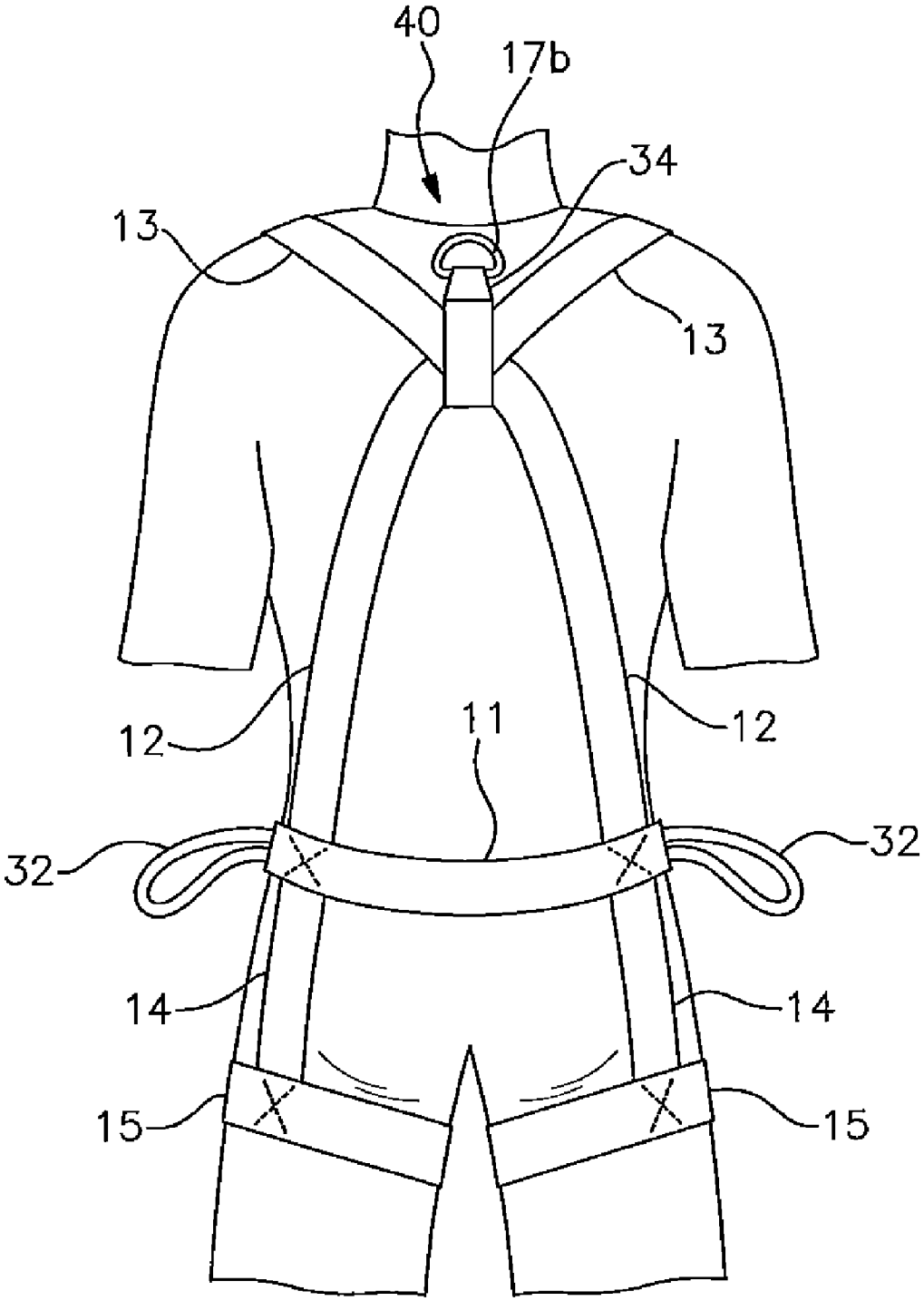
FIG. 4 is a back view of the invention shown in the in-use configuration on a body.
Figure 5:
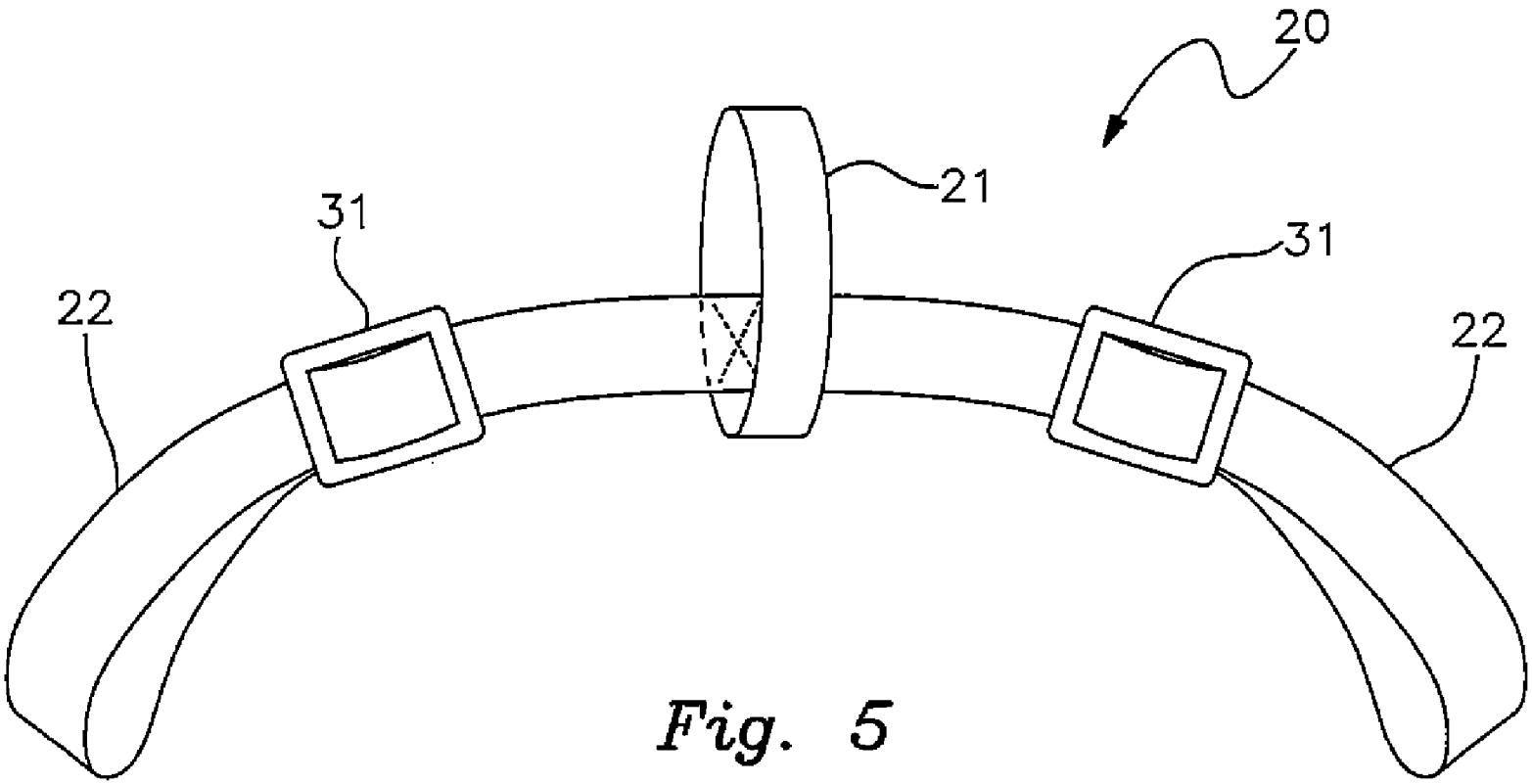
FIG. 5 is a view of the adjustable front tie-in assembly of the invention.

The rear shoulder straps 12 and the front shoulder straps 13 are joined by stitching or other suitable fixation means at a common junction on the rear side of the harness 10, and preferably extend therefrom in a general X-pattern centered between the shoulders, with the front shoulder straps 13 extending first upwardly and then downwardly over the chest when worn, as shown in FIGS. 3 and 4. The lower ends of the rear shoulder straps 12 are preferably fixedly attached to the waist strap 11 at a generally rearward location and the front shoulder straps 13 are preferably fixedly attached to the waist strap 11 at a generally forward location, using stitching or other suitable fixation means. Extending beneath the waist strap 11, preferably at the locations directly beneath the points of attachment of the rear shoulder straps 12, are rear leg straps 14, which are likewise fixedly joined to the waist strap 11. A thigh strap 15 is fixedly joined to the lower ends of each of the rear leg straps 14. Each thigh strap 15 comprises a connecting member 31, such as a double-pass buckle, such that a free end of the thigh strap 15 can be brought through the connecting member 31 and secured in an encircling manner about the wearer's thigh.

The common junction of the rear shoulder straps 12 and the front shoulder straps 13 preferably defines a rear arrest loop 34, which may comprise looped strap material, a ring or the like to receive a back tether or lanyard 17*a* or a D-ring, carabiner or the like 17*b*, in a hinge-like or pivoting manner such that movement of the back tether 17 relative to the rear arrest loop 34 is less restricted than would be encountered if the back tether 17*a* were fixedly connected. The free end of the back tether 17*a* is provided with a carabiner or similar joining member 33 such that it may be attached to a sling member 18 or similar strap, rope, chain or cable member secured to a tree, beam or like structure. The back tether 17*a* preferably extends approximately 18 to 24 inches, and is of sufficient length such that the carabiner 33 can be brought to the front of the wearer either over the shoulder or laterally around the torso. The back tether 17*a* may be formed of an elastic material or comprise folded material with break-away stitching in order to cushion the fall.

Preferably the harness 10 is also provided with a sternum strap 16 extending between the two front shoulder straps 13 at a location above the waist strap 11 to better secure the harness 10 to the wearer, such that sternum strap 16 will be positioned across the upper chest or sternum when the harness 10 is worn. The sternum strap 16 is a two-piece strap with a connecting member 31 allowing the two pieces to be releasably joined. The harness 10 is also preferably provided with a pair of lineman loops 32 disposed on each side of the waist strap 11, such that a slotted sling member 18 positioned around a vertical anchor member can attached to the loops 32 to support the user.

Figure 7:
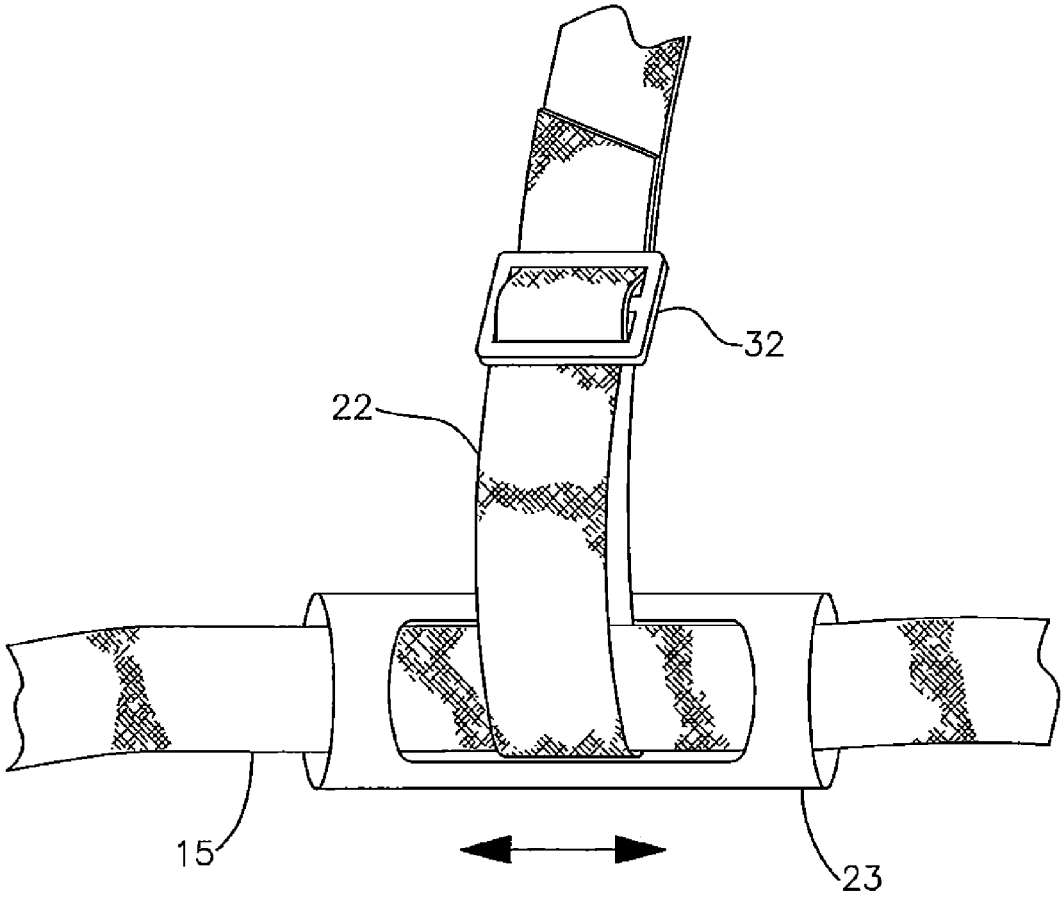
FIG. 7 is a perspective view of the slide connector joining the forward leg straps to the thigh strap.

The primary improved portion of the harness 10 comprises the adjustable front tie-in assembly 20. This front tie-in assembly 20 comprises a tie-in loop 21, preferably composed of a strap material but also suitably composed of a plastic or metal ring, for example, and forward leg straps 22, each of which are adjustable in length. The leg straps 22 may be formed as a single member fixedly joined to the lower portion of the tie-in loop 21, or may be composed of two separate strap members. A connecting member 31, again preferably a double-pass metal buckle, is positioned on each forward leg strap 22 to receive the free end of each forward leg strap 22. The leg straps 22 are each joined to a thigh strap 15 in a manner that allows the length of the leg straps to be adjusted and that allows the position of the leg strap 22 relative to the thigh strap 15 to be varied. Preferably, this is accomplished by providing slide connectors 23, whereby the leg strap 22 can be looped through the slide connector 23 and thigh straps 15 in a manner that allows it to be pulled from or pushed through the slide connector 23 to adjust its length, and whereby the slide connectors 23 can be repositioned along the thigh strap 15, as shown in FIG. 7.

Figure 11:
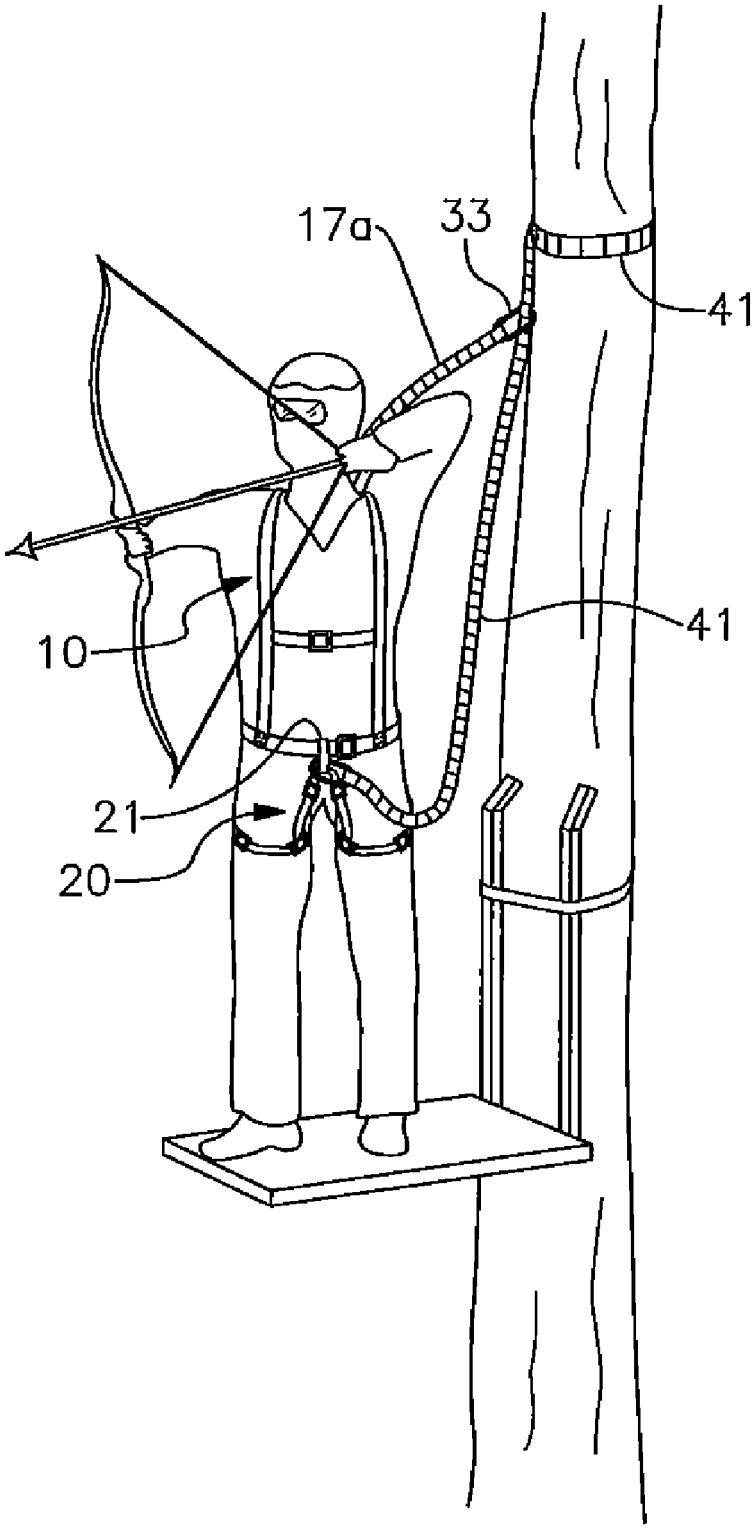
FIG. 11 is a view of the safety harness in the configuration for attachment to a vertical anchor member.
Figure 12C:
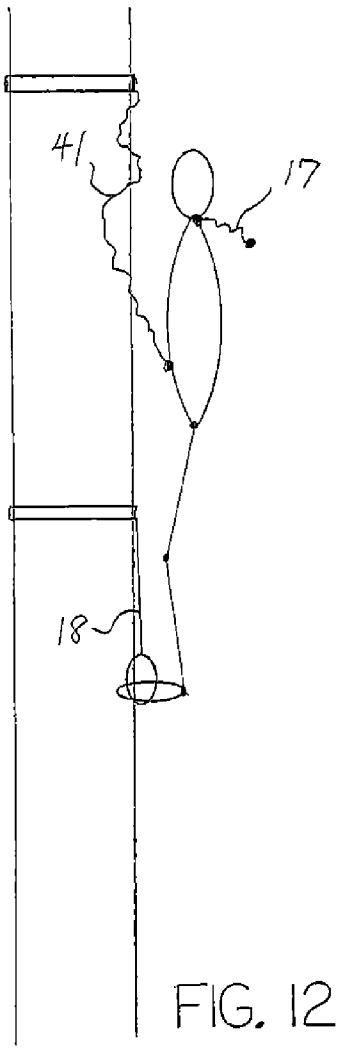
FIGS. 12A through 12F are successive schematic illustrations of the methodology for self-rescue from a vertical anchor member, with FIG. 12A illustrating the wearer suspended from the vertical anchor member, with FIG. 12B illustrating the step of attaching the tail portion of the safety line to the front tie-in loop, cinching the sling member to the vertical anchor member and forming the foot loop, with FIG. 12C illustrating the step of standing in the foot loop to slacken the back tether and detaching the back tether from the safety line, with FIG. 12D illustrating the step of repositioning the safety line to a lower position, with FIG. 12E illustrating the step of releasing the pressure on the foot loop so as to be suspended from the safety line, and with FIG. 12F illustrating the step of lowering the foot loop, wherein the steps illustrated in FIGS. 12C through 12F are repeated as necessary.
Figure 12B:
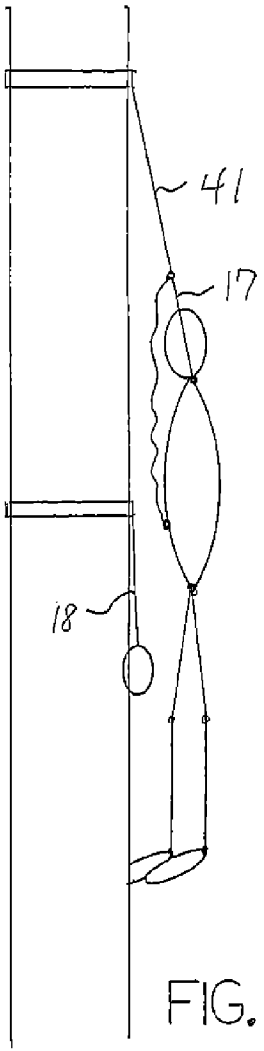
Figure 12A:
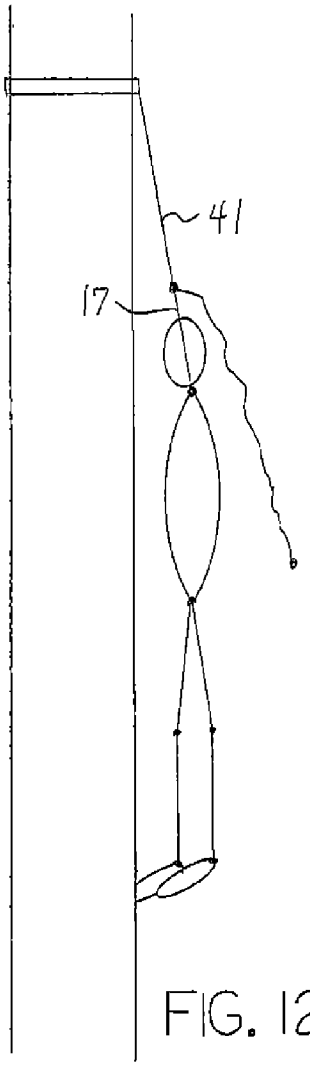
Figure 12F:
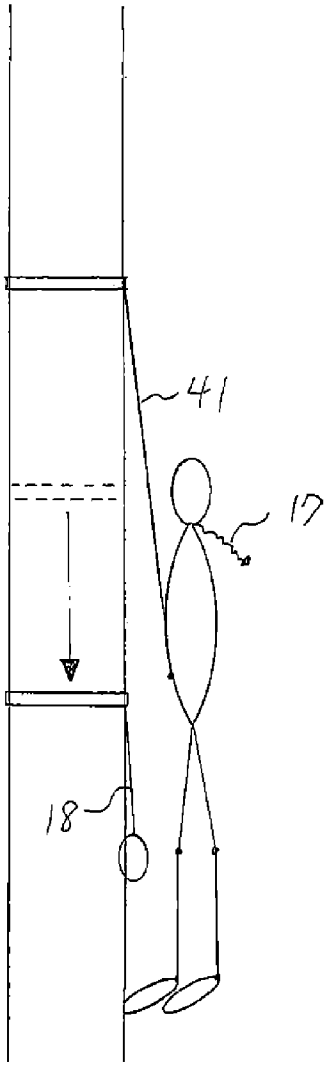
Figure 12E:
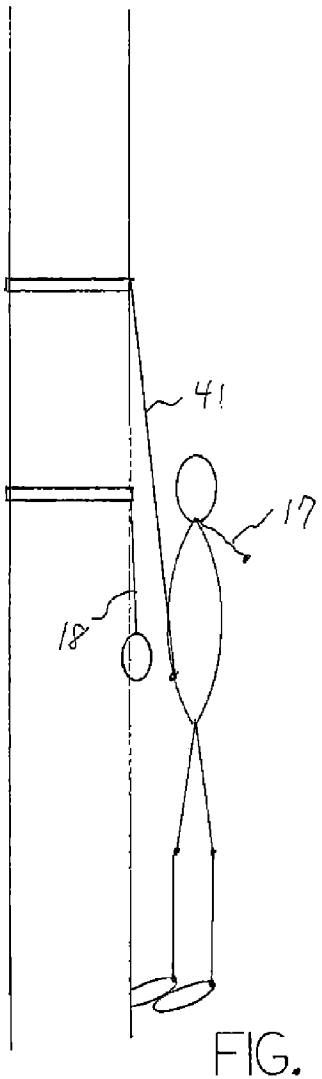
Figure 12D:
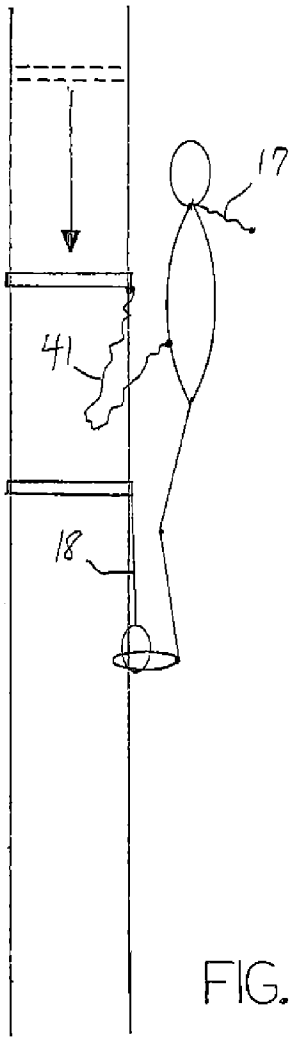

In use, the waist strap 11 is passed through the tie-in loop 21 prior to being buckled. With this configuration, the harness 10 provides two tethering members, the carabiner 33 of the back tether 17*a* for connecting the harness 10 in the rear, and the tie-in loop 21 for connecting the harness 10 in the front to the tree or other fixed vertical object. Preferably, multiple carabiners are provided, at least two locking and two non-locking, such that various combinations of strap connections can be made. In the case of a horizontal fixed anchor object, such as an overhead beam, the two tethering members would comprise a D-ring, carabiner or the like 17*b* attached to the rear arrest loop 34 and the tie-in loop 21. When the wearer is positioned at the desired location, the upper portion of the safety line 41 is mounted or connected to the anchor member. For a vertical anchor, after the wearer has reached the desired height and desires to face away from the vertical anchor, the safety line 41 is connected to the safety harness 10 by either the back tether 17*a* or ring 17*b* at a position relatively near the anchor member. If the free end of the safety line member 41 extending beyond the harness attachment point is sufficiently long, it may be attached to the front tie-in loop 21 at this time, as shown in FIG. 11. The structure of the adjustable tie-in assembly 20 in combination with the thigh straps 15 better disperses the pressure in the event the wearer falls and becomes suspended by the safety harness 10, since the wearer's body weight is not suspended by straps disposed in the crotch area. The adjustability in length of the forward leg straps 22 enables the thigh straps 15 to be properly located regardless of the height of the wearer. In addition, the structure of the adjustable tie-in assembly 20 in combination with the thigh straps 15 allows the wearer to more easily assume a more horizontal position, or at least a position where the legs are horizontal, which addresses the problem of suspension trauma.

In the event the wearer falls and is suspended from the safety line member 41 next to a tree or pole, the harness assembly 10 provides a method and means for relief of suspension trauma and self-rescue utilizing the sling members 18, which may be temporarily stored by attachment to points on the harness 10 or retained within pockets provided in a shell or vest-type garment that encircles the wearer's torso—the various strap members being secured at various points to the shell garment by slots, mechanical fasteners, stitching or the like. While the wearer is suspended from the rear, he first attaches the free end of the safety line 41 to the front tie-in loop 21 if this has not already been done. He then cinches one of the sling members 18 about the tree below the primary anchor point and forms a foot loop in the other end of the sling member 18 with a carabiner inserted through one of the sling member openings 19, the loop being positioned such that he can insert his foot with his knee being bent. Stepping into the foot loop, the wearer then raises his body sufficiently to slacken the back tether 17*a* and/or safety line 41. The wearer, being safely attached to the safety line 41 at the front tie-in loop 21, can now detach the safety line 41 from the ring 17*b* or from the back tether 17*a*. The wearer can now rest in a front suspended position that allows him to move his legs periodically or rest them horizontally against the vertical anchor to relieve suspension trauma. Additionally, the wearer can now work his way down or back up the tree in a self-rescue by alternately lowering or raising the foot loop and the primary safety line.

Figure 8:
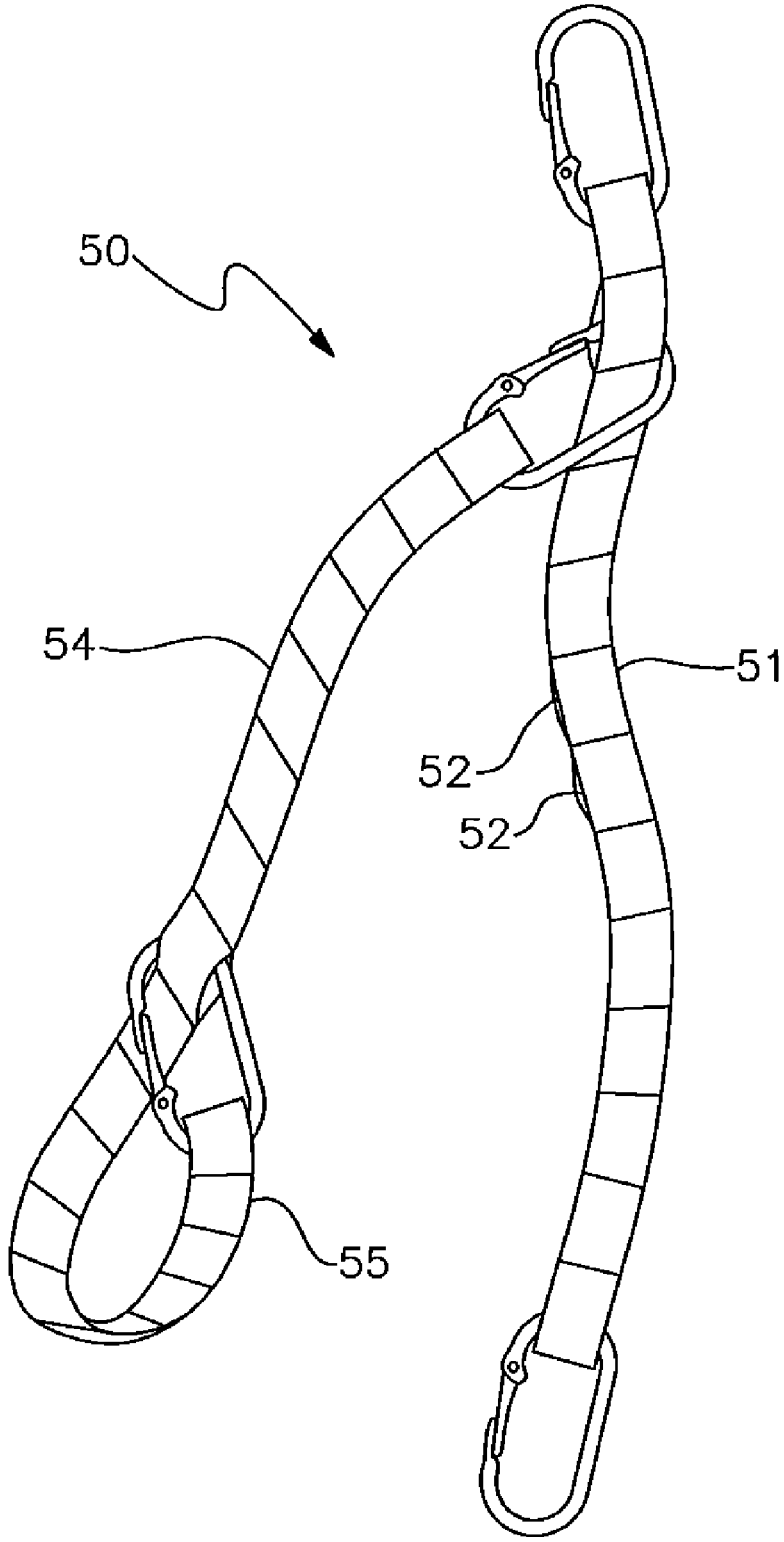
FIG. 8 is a view of the rear safety assembly embodying an extended safety line member and a foot loop sling member.
Figures 13A, 13B, 13C:
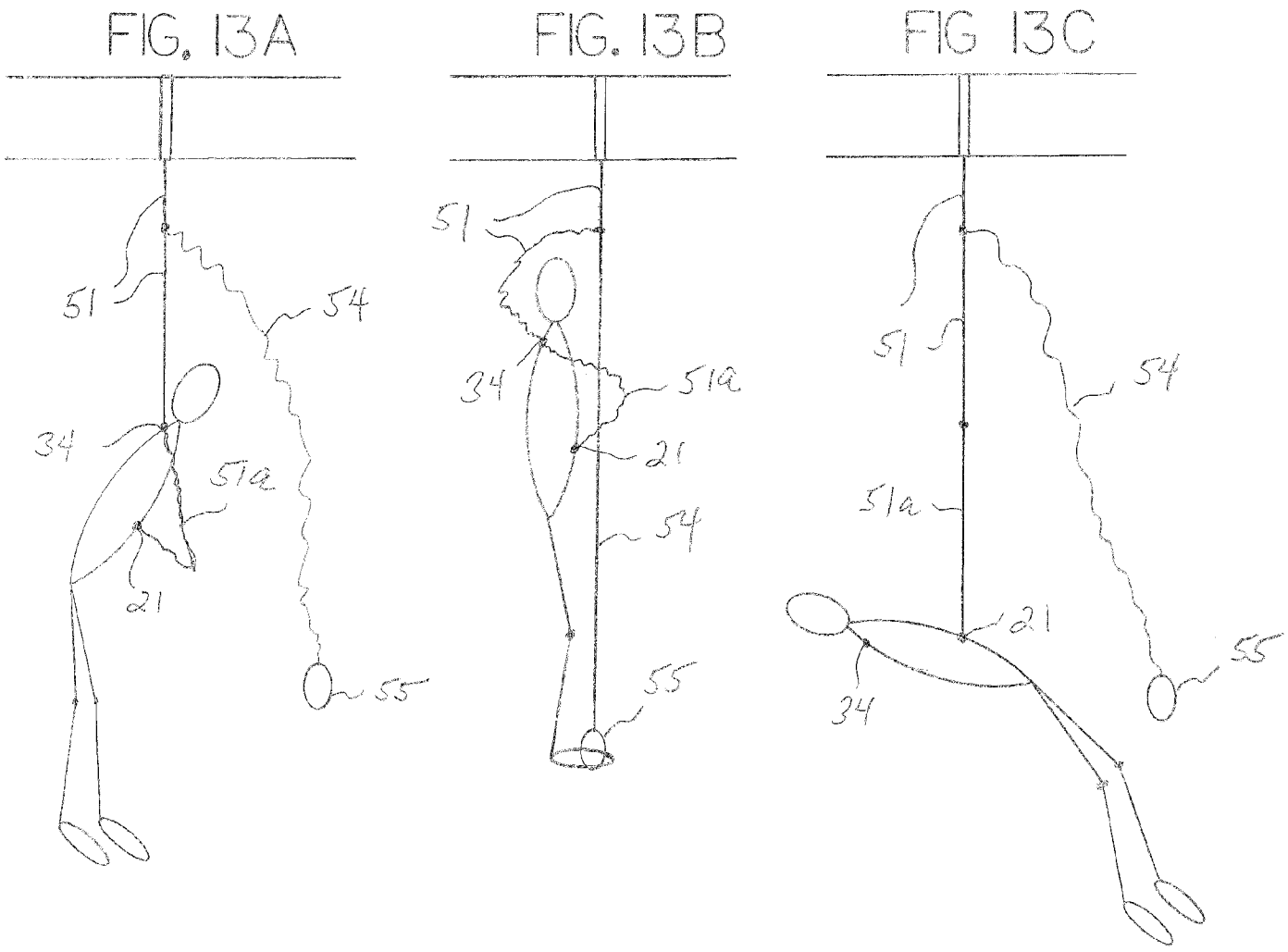
FIGS. 13A through 13E are successive schematic illustrations of the methodology for self-rescue from a horizontal anchor member, with FIG. 13A illustrating the wearer suspended from the horizontal anchor member after a fall with the tail portion of the slotted safety line member attached to the front tie-in loop, with FIG. 13B illustrating the step of standing in the foot loop to slacken the slotted safety line member for detachment from the rear arrest loop, with FIG. 13C illustrating the step of hanging suspended from the slotted safety line and tail portion, with FIG. 13D illustrating the step of raising the foot loop to slacken the slotted safety line member and tail portion, and attaching a sling member to the front tie-in loop and to the highest reachable point on the slotted safety line member, with FIG. 13E illustrating the step of hanging suspended from the slotted safety line and sling member, wherein the steps illustrated in FIGS. 13C through 13E are repeated as necessary.
Figure 13E:
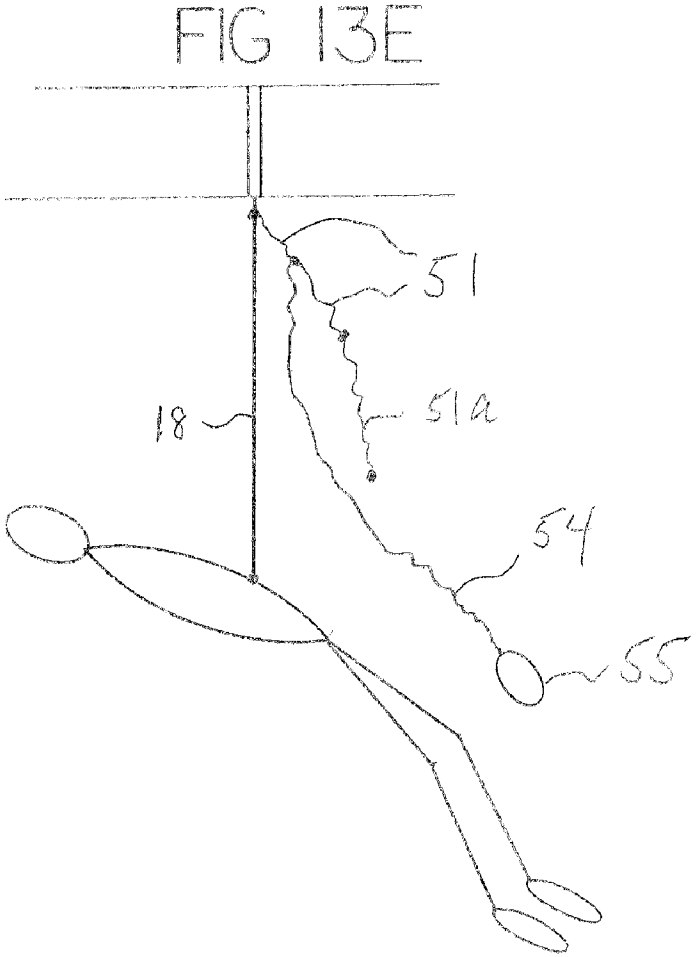
Figure 13D:
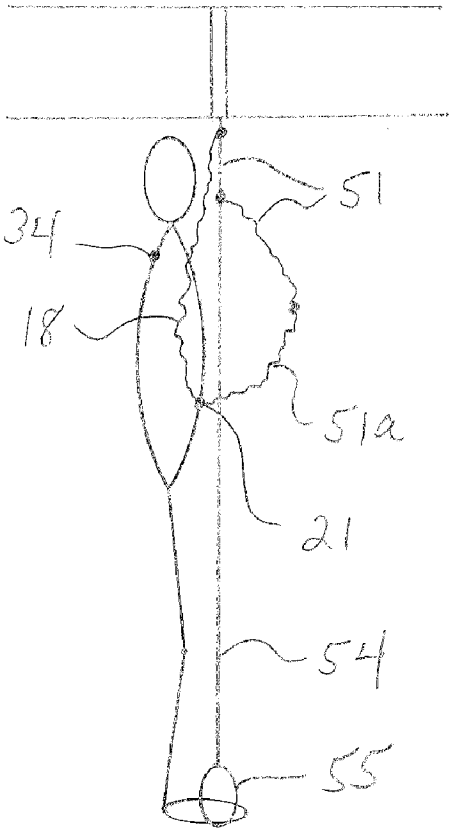

For circumstances where a horizontal member, such as an overhead beam, comprises the anchor member to arrest the fall, the harness apparatus 10 will further comprise a rear safety assembly 50 which can take several configurations. In a first configuration, as shown in FIG. 8, the rear safety assembly comprises slotted safety line member 51 having a number of openings 52, with the slotted safety line member 51 attached to the horizontal anchor. A foot loop sling member 54, also preferably multiply apertured, is connected to the slotted safety line member 51 at a point above the harness connection point of the slotted safety line member 51. The slotted safety line member 51 may be directly connected to the back of the safety harness 10 at the rear arrest loop 34 or at the rear ring 17*b*, or the slotted safety line member 51 may be connected to the rear tether 17*a*. With the slotted safety line member 51 attached to the harness 10 at an interior point on the slotted safety line member 51, the tail portion 51*a* below this connection point can be left free or attached to the front tie-in loop 21. In the event of a fall, the wearer will be suspended from the slotted safety line member 51. If the tail portion of the slotted safety line member 51 is not already attached to the front tie-in loop 21, this is now done, as shown in FIG. 13A. The wearer then sets the foot loop 55 of the foot loop sling member 54 to the proper bent-knee height to allow him to rise up and put slack into the slotted safety line member 51 at the rear connection point, as shown in FIG. 13B. The slotted safety line member 51 is now detached from the rear of the harness 10 such that the wearer is suspended from the front, as shown in FIG. 13C. The wearer can now remain suspended in a horizontal disposition until rescued, or if necessary can self-rescue. This is accomplished by raising the foot loop 55, stepping into the foot loop 55 to create slack in the slotted safety line member 51, and attaching a sling member 18 to the front tie-in loop 21, as shown in FIG. 13D, and the highest reachable point on the safety line 51 such that the wearer is now suspended from the sling member 18, as shown in FIG. 13E. The foot loop 55 is again raised, slack in the sling member 18 is created and the tie-in loop 21 is secured to a higher point on the slotted safety line member 51, and the tail portion 51*a* of the slotted safety line member 51 is then detached from the tie-in loop 21. These steps are repeated as necessary.

Figure 9:
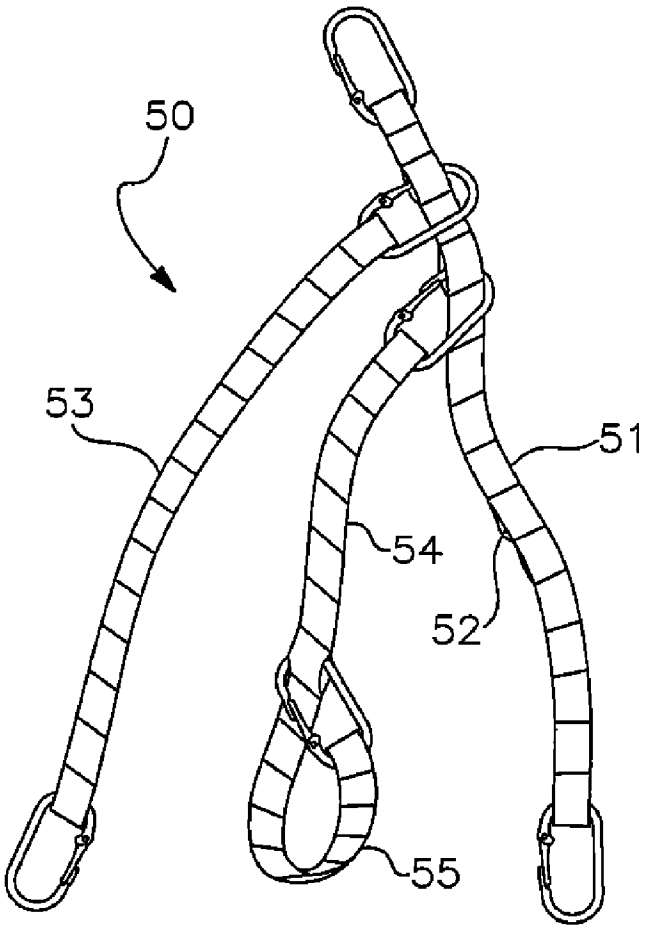
FIG. 9 is a view of an alternate embodiment of the rear safety assembly wherein a front tether member is also included.

In a second configuration for the rear safety assembly 50, shown in FIG. 9, wherein there is no tail portion 51*a* on the slotted safety line member 51 in that the lower end of the slotted safety line member 51 is connected to the harness 10, a front tether member 53 comprising a slotted webbing is attached to the slotted safety line member 51 and attached to the front tie-in loop 21. In the event of a fall, the foot loop 55 is set at the proper height, slack is created in the slotted safety line member 51 and it is detached from the rear of the harness 10. The wearer is now suspended from the front and the same steps as above are then repeated to self-rescue.

Figure 10:
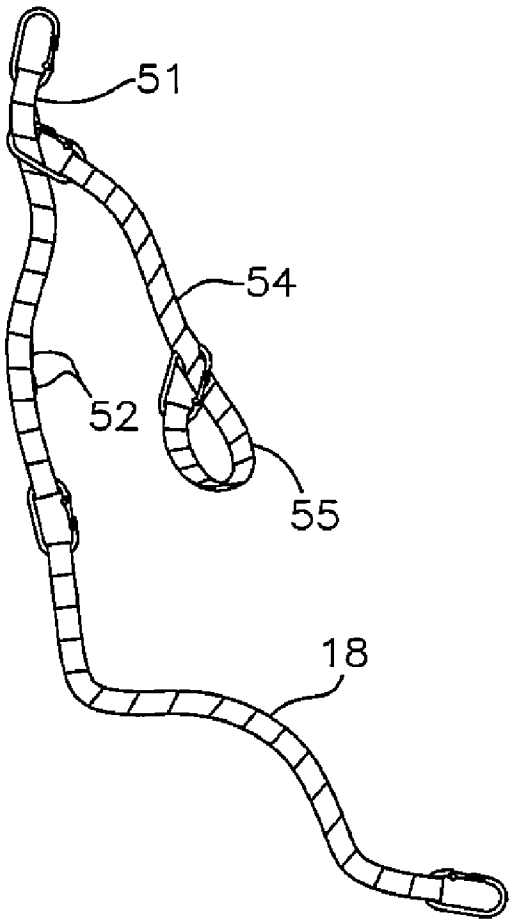
FIG. 10 is a view of an alternate embodiment of the rear safety assembly wherein a slotted sling member is attached below the slotted safety line.

In a third configuration for the rear safety assembly 50, shown in FIG. 10, a slotted sling member 18 is connected to the end of the slotted safety line member 51. The safety harness is connected at the rear to an interior point on the sling member 18 and the lower end of the sling member 18 is attached to the front tie-in loop 21. Front suspension and self-rescue after a fall is accomplished in the same manner as above, wherein the rear attachment to the sling member 18 is removed after slack is created by the foot loop methodology.

It is understood that equivalents and substitutions for certain elements set forth above may be obvious to those skilled in the art, and therefore the true scope and definition of the invention is to be as set forth in the following claims.

I claim:

1. A method of self-rescue and suspension trauma relief for a safety harness wearer accidentally suspended from a horizontal anchor member by a slotted safety line member connected to the rear of the safety harness comprising the steps of:

(a) providing a safety harness assembly comprising a waist strap, rear shoulder straps and front shoulder straps connected to said waist strap, and a front tie-in loop disposed on said waist strap;

(b) providing a rear safety assembly, said rear safety assembly comprising said slotted safety line member connected to said horizontal anchor member and at an interior point to the rear of said safety harness, thereby defining a tail portion, and a foot loop sling member comprising a foot loop, said foot loop sling member connected to said slotted safety line member;

(c) donning said safety harness;

(d) attaching said slotted safety line member to said horizontal anchor member;

(e) after falling such that the wearer is suspended from said horizontal anchor member by said slotted safety line member connected to the rear of said safety harness, securing said tail portion to said front tie-in loop;

(f) setting said foot loop on said slotted safety line member at bent-knee height;

(g) standing in said foot loop to slacken said slotted safety line member beneath the point where said foot loop sling member is connected; and (h) disconnecting said slotted safety line member from the rear of said safety harness, whereby the wearer is suspended from said horizontal anchor member by said slotted safety line member and said tail portion, further comprising the steps of:

(i) providing a sling member;

(j) raising said foot loop and standing in said foot loop to slacken said slotted safety line member;

(k) connecting said sling member to said front tie-in loop and to said slotted safety line member at the highest reachable point whereby the wearer is suspended from said sling member and said front-tie-in loop.

2. The method of claim 1, further comprising the steps of:

(l) raising said foot loop and standing in said foot loop to slacken said sling member;

(m) disconnecting said sling member from said slotted safety line member and reconnecting said sling member to said slotted safety line member at the highest reachable point;

(n) repeating steps (j) through (m) as necessary to achieve self-rescue.

* * * * *